United States Patent [19]

Rotrekl et al.

[11] 4,240,471

[45] Dec. 23, 1980

[54] LOOM BACK REST MECHANISM

[75] Inventors: Otto Rotrekl, Brno; Vladimir Vasicek, Moravsky Krumlov; Jindrich Henzl, Brno, all of Czechoslovakia

[73] Assignee: Vyzkumny a vyvojovy ustav Zavodu vseobecneho strojirenstvi, Brno, Czechoslovakia

[21] Appl. No.: 940,105

[22] Filed: Sep. 6, 1978

[30] Foreign Application Priority Data

Sep. 7, 1977 [CS] Czechoslovakia ..... 5813-77

[51] Int. Cl.[3] ..... D03D 49/22

[52] U.S. Cl. ..... 139/114

[58] Field of Search ..... 139/109, 110, 114, 115, 139/145; 66/213; 242/45, 75.2, 75.3, 75.5, 147, 154, 156, 156.2

[56] References Cited

U.S. PATENT DOCUMENTS

| | | | |
|---|---|---|---|
| 2,507,828 | 5/1950 | Stephensen et al. | 139/114 |
| 2,674,110 | 4/1954 | Roughsedge et al. | 139/114 |
| 2,813,549 | 11/1957 | Pfarrwaller | 139/145 |
| 2,966,930 | 1/1961 | Pfarrwaller | 139/114 |
| 3,423,045 | 1/1969 | Frenger | 242/154 |
| 4,108,214 | 8/1978 | Mullekom | 139/114 |

*Primary Examiner*—Henry Jaudon

[57] ABSTRACT

There is disclosed a back rest mechanism for a loom. In a first disclosed embodiment a back rest roller is rotatably mounted on the outer ends of parallel arms or levers, mounted for oscillation about their inner ends, which are connected for joint movement by a hollow back rest shaft. Deflection of the back rest roller by the warp passing from the warp package on the warp beam to the shed of the loom is resiliently opposed by one or more torque rods extending between and connected to a central portion of the back rest shaft and a fixed part or structure, such as the frame, of the loom. Means is provided for adjusting the basic torque to which the torsion bar or bars are subjected under a predetermined set of operating parameters of the loom.

In a second disclosed embodiment the hollow back rest shaft is fixed against rotation about its axis, the laterally inner ends of two aligned torque rods are secured to the hollow back rest shaft intermediate its length, and the radially inner ends of the parallel arms or lenses are secured to the laterally outer ends of the respective torque rods.

10 Claims, 5 Drawing Figures

LOOM BACK REST MECHANISM

The present invention relates to a back rest mechanism for a loom, such mechanism providing improved operating conditions in looms equipped with a movable back rest.

Movable back rests for looms provide compensation for variations in the tensions of the warp threads which arise, for example, by reason of the formation of sheds in the wrap. Ideally, the movement of a back rest roller should be as small as possible. The operation of the back rest mechanism is influenced by the working speed of the loom, the radius of the package of the warp threads on the warp beam, the weight or mass of the back rest roller, and various tension components which result in the total tension to which the warp threads are subjected.

In known back rest mechanisms a back rest shaft is connected by means of arms or levers to a back rest roller, one arm being in the form of a double-arm lever to permit the end of the lever opposite to that carrying the back rest roller to be loaded either directly or by means of transmission levers by a load or spring. Such back rest mechanisms have a very substantial moving mass, and their use as a warp let-off motion sensor is thus difficult.

The back rest mechanism in accordance with the present invention eliminates the above-described drawbacks of the prior art. The back rest mechanism of the present invention includes a hollow back rest shaft within which there is mounted at least one torsion bar or rod which is connected to an intermediate portion of the hollow back rest shaft and extends outwardly beyond one end of the hollow shaft to a fixed or structure, such as the frame, of the loom. In one embodiment the back rest shaft is rotatable and means are provided at the outer end of the torque rod or bar which adjustably connect it to fixed structure, such as the loom frame, whereby the initial torque to which the torque rod and thus the back rest shaft are subjected may be adjusted. The hollow back rest shaft is preferably divided so as to receive between the parts thereof the axially inner end of the torque rod, which may be in the form of a hub rigidly but dismountably connected to the ends of the parts of the torque shaft which it confronts. The hollow back rest roller is rotatably mounted upon the ends of arms or levers which extend from and arr rigidly connected to the respective axially outer ends of the back rest shaft.

In another embodiment the hollow back rest shaft is fixedly secured against rotation to fixed structures such as the frame of the loom. Two similar torque rods or bars are employed, such rods being aligned and disposed within the hollow back rest shaft along the axis thereof. The axially inner, confronting ends of the torque rods are connected to the hollow back rest shaft centrally thereof, so as to be held from rotation with respect thereto. The axially outer ends of the respective torque rods are fixedly connected to the radially inner ends of arms or levers; as in the first embodiment the back rest roller is disposed between and journalled upon the radially outer ends of the arms or levers.

The present invention has among its objects the provision of an improved back rest mechanism which provides to the highest degree a uniform tension of the warp threads being fed to the loom during the working cycle, and the correct operation of the warp let-off motion. The mechanism of the invention eliminates a spring-loaded arm and reduces the moment of inertia of the mechanism; the back rest mechanism of the invention is particularly characterized by the accuracy with which it compensates for differences in the tension of the warp threads during the working cycle of the loom. The reduction of the total length of the back rest mechanism and a more suitable distribution of the mass of the moving parts thereof with respect to the center of oscillation of the back rest mechanism result in a more favorable stressing of the majority of the parts of the mechanism.

A further advantage of the back rest mechanism of the invention is the elimination of an oscillating mass on the back rest arms or levers. More space is provided between the side walls of the frame of the loom and the warp beam. At the same time, the number of parts of the back rest mechanism is reduced, conditions of assembly of the mechanism are improved, and the manner of adjusting the basic tension of the warp threads, and of changing such adjustment when necessary, is facilitated.

The invention will be more readily understood upon consideration of the accompanying drawings, in which.

Figure 1:
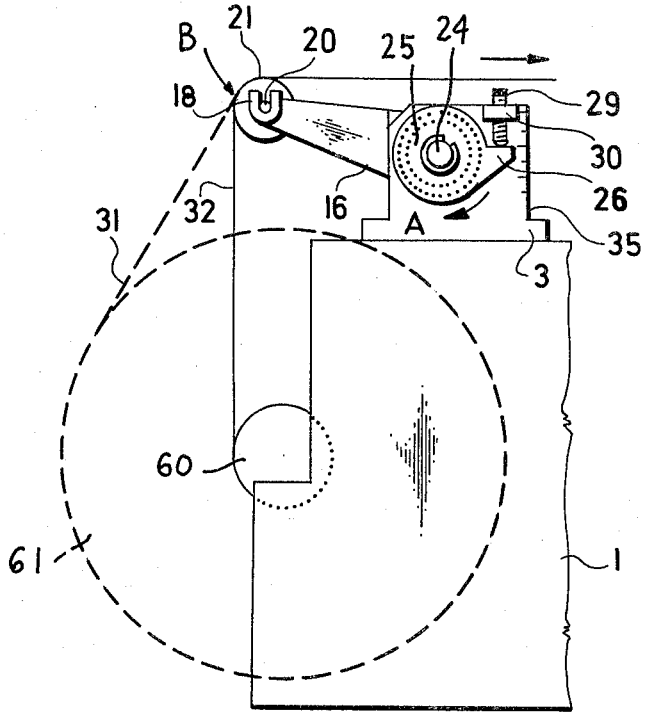
FIG. 1 is a view in side elevation of a first embodiment of the back rest mechanism in accordance with the invention, the view being taken in a direction from right to left in FIG. 2.
Figure 2:
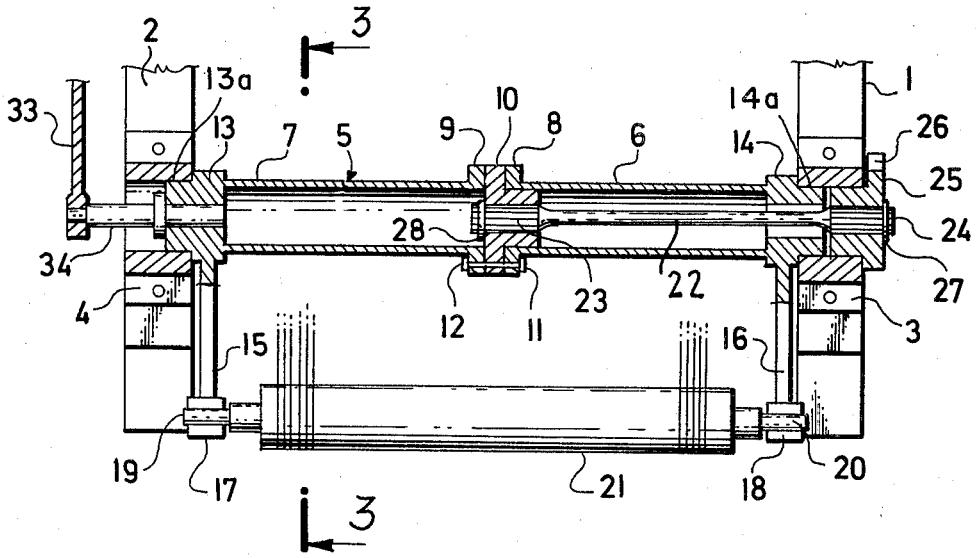
FIG. 2 is a fragmentary view partially in plan and partially in horizontal section through the back rest mechanism shown in FIG. 1.
Figure 3:
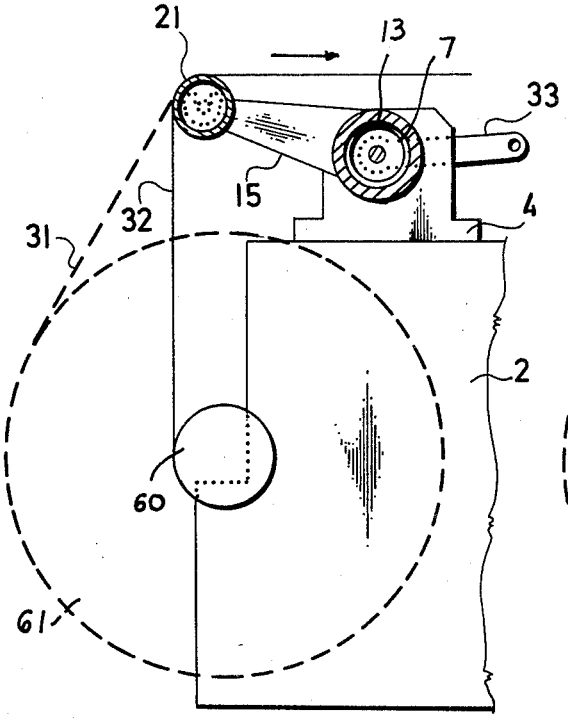
FIG. 3 is a view in vertical section through the back rest mechanism, the section being taken along the line 3—3 in FIG. 2.
Figure 5:
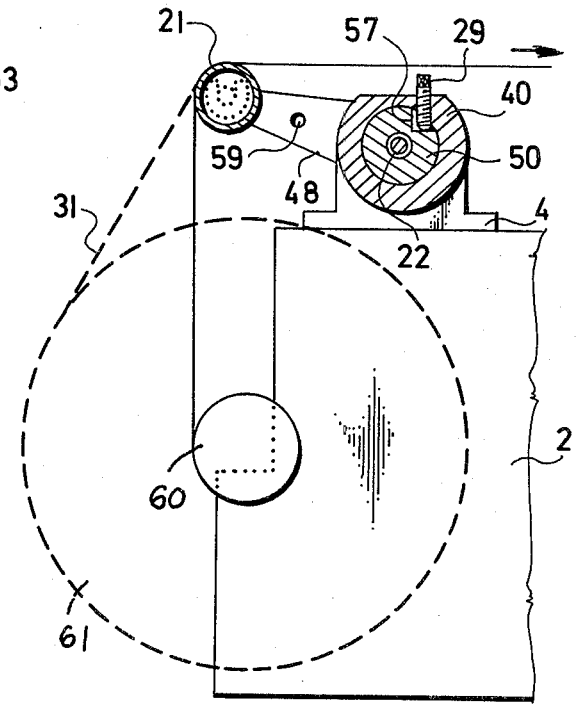
FIG. 5 is a view in vertical section through the mechanism of FIG. 4, the section being taken along the line 5—5 in FIG. 4.
Figure 4:
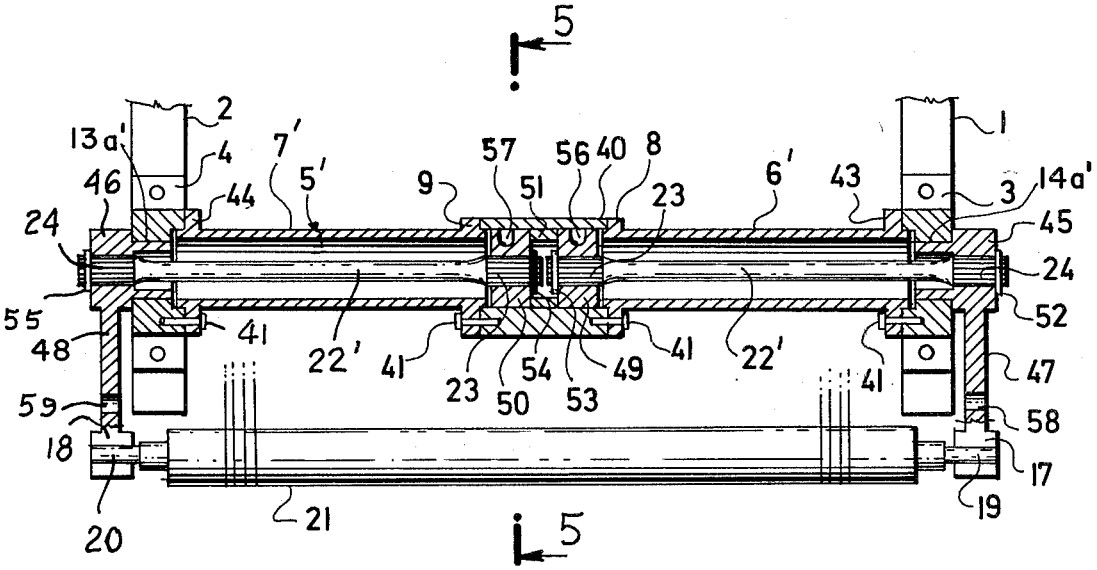
FIG. 4 is a fragmentary view, partially in plan and partially in horizontal section, through a second embodiment of back rest mechanism in accordance with the invention.

As is apparent from the above, two embodiments of the back rest mechanism of the invention are shown and described herein. The first such embodiment, which employs a single torque rod or bar, is shown in FIGS. 1, 2, and 3; the second embodiment, which employs two torque rods or bars, is shown in FIGS. 4 and 5. The same reference characters as in FIGS. 1, 2 and 3 are employed in FIGS. 4 and 5 to designate the same or similar parts.

Turning first to FIGS. 1, 2, and 3, there is there fragmentarily shown the end of a loom at which a warp beam 60 is rotatably mounted between side members 1 and 2 of the frame of the loom which form a part of the fixed structure thereof. Warp threads from the warp package 61 on the warp beam are fed upwardly and partially around a back rest roller 21 from which they proceed to the shed-forming mechanism (not shown) of the loom. In FIGS. 1 and 3 the warp proceeding from a full warp package 61 to the back rest roller 21 is shown in dash lines at 31; warp proceeding from a nearly empty warp beam to the back rest roller 21 is shown by a full line 32.

The back rest mechanism is supported in brackets 3 and 4 which are mounted upon frame parts 1 and 2, respectively. A composite hollow back rest shaft 5 made up of coaxial tubes 6 and 7 is provided at its opposite ends with shaped hollow journals 13 and 14 which rotate in bores 13*a*, 14*a*, respectively, in brackets 4 and 3. The back rest shaft 5 is divided at the center and is rigidly connected by flanges 8 and 9 to a hub 10 by machine screws 11 and nuts 12 extending through the flanges and the hub. Levers 15 and 16 are integrally attached to journals 13 and 14, respectively, from which they extend radially, levers 15 and 16 having upwardly open partial sleeves 17 and 18, respectively, at their outer ends. The back rest roller 21 is rotatably mounted in the sleeves 17 and 18 by means of stub axles 19 and 20, respectively.

Inside the tube 6 of the back rest shaft 5 there is mounted a torsion bar or rod 22 disposed coaxial thereof, a ribbed head 23 on the inner end of bar 22 being rigidly and dismountably affixed to the hub 10, the outer end of bar 22 having a ribbed head 24 rigidly and dismountably connected to a torque hub 25 which is rotatably mounted in the bracket 3. The torque hub 25 is provided with a radial projection 26. The axial position of the torsion bar 22 is secured by retaining rings 27, at the outer end thereof, and 28, at the inner end thereof, A set screw 29 is mounted in a fixed rest 30 on the bracket 3. The lower end of the set screw engages the projection 26 of the torque hub 25. It will thus be seen that, by turning screw 29 in the appropriate direction, the torque rod 22 may be subjected to a predetermined desired torque when the loom is runniing under a predetermined set of conditions. A lever 33 rigidly and dismountably connected to a stub shaft 34 connected to the journal 13 forms a part of a warp let-off motion sensor, which is not otherwise illustrated.

It will be seen from the above that the head 23 on the axially inner end of the torque rod 22 is connected to the left hand lever 15 through the flange 10, the flange 9, the tube 5, and the hub 13, which are all connected in series and constitute a connecting means. The head 23 is connected to the right hand lever 16 through the flanges 10, 8, the tube 6, and the hub 14, which are all connecting series and also constitute a connecting means.

The above-described back rest mechanism of FIGS. 1–3, inclusive, functions as follows: The basic torque of the torsion bar 22 is adjusted, in accordance with a previously calibrated scale 35 disposed on the bracket 3, taking into consideration the number of warp thread ends and the desired density of the fabric being woven by the loom. Such adjustment is carried out by appropriately positioning the projection 26 of the torque hub 25 by the set screw 29. Due to the rigid connection between the torque hub 25 and the head 24 of the torsion bar 22 and between the head 23 of the torsion bar 22 and the hub 10, the angular displacement, caused by changing the position of the projection 26, is transmitted to the back rest shaft 5 and also to the sleeves 17, 18 on the levers 15, 16 and thus to the back rest roller 21. Thus when the set screw 29 is screwed down, the levers 15 and 16 are angularly displaced in the direction of the arrow A in FIG. 1. The moment of torque produced in such manner is opposite to that produced by the tension of the warp threads in their path 31 with a maximum diameter of the warp package 61 and which exists during the whole period of weaving until the warp package 61 reaches a minimum diameter and the warp travels along the path 32. The force which is exerted upon the back rest roller 21 by the warp threads in their passage thereover is shown generally by the arrow B in FIG. 1.

During weaving, the above-described basic torque adjustment may be altered according to the weaving conditions. The lever 33 that serves as a back rest sensor detects the position for the above-referred to warp let-off motion (not shown). The resultant position of the back rest roller 21 is derived from the angular displacement of the levers 15 and 16 affixed to the back rest shaft 5. The means 26, 29, and 30 for adjusting the basic torque of the rod 22 and for making further adjustments thereof, are disposed at a location well away from the weaving plane of the loom and outside the side frame members 1 and 2 thereof, and thus are easily accessible while the loom is operating, as well as when it is at rest.

The second disclosed embodiment of the back rest mechanism of the invention, shown in FIGS. 4 and 5, is particularly adapted for larger, that is, wider looms. In this embodiment, the brackets 3 and 4 on side frame members 1 and 2, respectively, of the loom rotatably support a back rest shaft 5' made up of two coaxially arranged parts 6' and 7' provided with shaped flanges 43 and 44 at the ends thereof which are supported in the respective brackets 3 and 4. The back rest shaft 5' is centrally divided, the parts thereof being rigidly connected to each other as by flanges 8, 9 and a connecting piece 40. Connecting elements 41 such as screws rigidly connect the flanges 8 and 9 and the connecting piece 40 together. The connecting elements 41 may also be used to form a rigid connection of the shaped flanges 43 and 44 at the outer ends of the respective parts 6' and 7' of the back rest shaft 5' with the brackets 3 and 4.

Hubs 45 and 46 of levers or arms 47 and 48, respectively, are rotatably mounted in bores 14*a'* and 13*a'* respectively, in levers 47 and 48 being provided with upwardly open partial sleeves 17 and 18, respectively. The back rest roller 21 is rotatably mounted in the sleeves 17, 18 by means of stub shafts 19, 20.

Two torsion bars 22' are employed, the axially inner heads 23 of such torsion bars being rigidly and dismountably connected to torque hubs 49 and 50, respectively. The other, axially outer, heads 24 of the torsion bars 22' are rigidly connected to hubs 45 and 46, respectively, levers 47 and 48. The torque hubs 49, 50 are rotatably mounted in a connecting piece 40, which is in the form of a sleeve. The axial positioning of the hubs 49, 50 is determined and maintained by a spacing sleeve 51. Retaining rings 52, 53, 54, and 55 secure the axial position of the torsion bars 22'.

In the above-described second embodiment of the invention, the axially inner head 23 of each of the torque rods 22' is fixedly connected to the frame of the loom in the same manner. Thus the right hand torque rod 22', for example, is connected to frame member 1, a fixed structure, by serially connected member 49, sleeve 40, flange 8, tube 6', and flange 43, such serially connected parts constituting a means for connecting the said head 23 to the fixed frame member 1 of the loom. In this embodiment, of course, the axially outer head 24 of the right hand torque rod 22' is connected to the lever 47 through hub 45.

The initial adjustment of the torsion to which the respective torsion bars 22' are subjected is provided by set screw means 29 (FIG. 5) threadedly mounted in the connecting piece 40, the inner end of the set screws 29 engaging in recesses 56 and 57 in a part of the periphery of the respective torque hubs 49 and 50. The levers 47 and 48, which carry the back rest roller 21, are provided with holes 58 and 59, respectively, in which back rest feelers (not shown) may be inserted.

The back rest mechanism shown in FIGS. 4 and 5 functions in a manner similar to that described above in connection with the embodiment of FIGS. 1–3, inclusive. The adjustment of the basic torque exerted upon the back rest roller 21 by the respective levers 47 and 48 is effected by the respective ones of the two torque adjusting means 29. This arrangement is particularly advantageous for looms having certain weaving widths, because the basic torque imposed upon each of the torsion bars 22' can be adjusted independently of each other.

In looms of still greater weaving width, two warp beams may be used, each such warp beam being provided with a back rest roller mechanism in accordance with that shown in FIGS. 4 and 5. The warp let-off motions of the two warp beams are connected by a differential gear box.

The embodiment of FIGS. 4 and 5 can also be employed with electrically controlled warp let-off motions. Back rest feelers affixed to the levers 47 and 48 at the openings 58 and 59 therein detect the position for the electrically controlled warp let-off motions independently for each warp beam.

Although the invention is illustrated and described with reference to a plurality of preferred embodiments thereof, it is to be expressly understood that it is in no way limited by the disclosure of such a plurality of embodiments, but is capable of numerous modifications within the scope of the appended claims.

What is claimed is:

1. A movable back rest mechanism for a loom having a fixed structure, a warp beam, and a back rest roller over which warp from the warp beam travels on its way into the loom, the back rest roller yieldably deflecting the warp as it travels from the warp beam into the loom, said mechanism comprising means for supporting and resiliently opposing deflection of the back rest roller by the warp, said last-named means comprising a torque rod extending transversely of the path of the warp fed from the warp beam into the loom, levers extending transversely of the torque rod from hubs on the levers coaxial of the torque rod, bearing means on the outer end of the levers rotatably mounting the back rest roller, means securing a first end of the torque rod against turning of such first end of the torque rod by the force imposed on the back rest roller by the warp, and means securing the second end of the torque rod to the hubs of the levers so as to turn therewith.

2. Mechanism according to claim 1, wherein the means securing a first end of the torque rod to the fixed structure of the loom against turning of such first end of the torque rod by the force imposed on the back rest roller by the warp comprises means for adjusting the torque to which the torque rod is subjected under warp feeding conditions.

3. Mechanism according to claim 2, wherein the means for adjusting the torque to which the torque rod is subjected under warp feeding conditions comprises a radially extending member fixedly connected to one end of the torque rod, and an adjustable stop member mounted on the fixed structure of the loom and engaging the radially extending member to subject the torque rod to a predetermined torque opposing the torque imposed upon the lever means by the warp passing over the back rest roller under warp feeding conditions of the loom.

4. Mechanism according to claim 1, comprising a transverse tube within which the torque is disposed, means including the hubs for the levers mounting the tube for rotation about its axis, the hubs of the levers are secured to the tube coaxially thereof, and wherein the means securing the second end of the torque rod to the hubs of the levers so as to turn therewith comprises and tube.

5. Mechanism according to claim 4, wherein the torque rod is disposed coaxially of the tube.

6. Mechanism according to claim 4, wherein the second end of the torque rod is secured to the tube at a location intermediate the length of the tube.

7. Mechanism according to claim 4, wherein there are two similar parallel levers which mount the back rest roller between them, said levers having hubs secured to respective opposite ends of the tube.

8. A movable back rest mechanism for a loom having a fixed structure, a warp beam, and a back rest roller over which warp from the warp beam travels on its way into the loom, the back rest roller yieldably deflecting the warp as it travels from the warp beam into the loom, means for supporting and resiliently opposing deflection of the back rest roller by the warp, said last named means comprising two similar aligned coaxial torque rods which together substantially span the loom from side to side transversely of the warp fed from the warp beam, means securing the confronting laterally inner ends of the torque rods against rotation about their axes, two similar parallel levers having hubs secured to respective opposite outer ends of the two torque rods, means mounting the hubs of the levers upon fixed structure of the loom for rotation with respect thereto, and bearing means at the radially outer ends of the levers for rotatably mounting the back rest roller between them.

9. Mechanism according to claim 8, wherein the means securing the confronting laterally inner ends of the torque rods against rotation about their axes comprises a transversely extending tubular means within which the torque rods are disposed, the opposite ends of the tubular means being fixedly secured to fixed structure of the loom on opposite sides thereof, and means securing the laterally inner ends of the torque rods to the tubular means intermediate the length thereof.

10. Mechanism according to claim 9, wherein the means securing the confronting laterally inner ends of the torque rods against rotation about their axis comprises means for adjusting the connection between the laterally inner ends of the torque rods and the tubular means, whereby to adjust the rorque to which the torque rods are subjected under warp feeding conditions of the loom.

* * * * *